US007156256B2

(12) United States Patent
Senda et al.

(10) Patent No.: US 7,156,256 B2
(45) Date of Patent: Jan. 2, 2007

(54) ITEM TAKING-OUT CONTAINER

(75) Inventors: Junji Senda, Kanagawa (JP); Kazutake Suda, Tokyo (JP)

(73) Assignee: Kabushiki Kaisha Bandai, Tokyo (JP)

( * ) Notice: Subject to any disclaimer, the term of this patent is extended or adjusted under 35 U.S.C. 154(b) by 479 days.

(21) Appl. No.: 10/333,050

(22) PCT Filed: May 14, 2001

(86) PCT No.: PCT/JP01/03995

§ 371 (c)(1),
(2), (4) Date: Jan. 13, 2003

(87) PCT Pub. No.: WO02/092464

PCT Pub. Date: Nov. 21, 2002

(65) Prior Publication Data

US 2003/0173371 A1 Sep. 18, 2003

(51) Int. Cl.
*B23Q 7/04* (2006.01)
*B65H 9/06* (2006.01)

(52) U.S. Cl. ..... 221/172; 221/210

(58) Field of Classification Search ..... 221/210, 221/220, 24, 228, 229, 251, 255, 261, 172, 221/236, 249, 248, 156, 163, 166, 171; 222/490; 141/381

See application file for complete search history.

(56) References Cited

U.S. PATENT DOCUMENTS

| | | | | |
|---|---|---|---|---|
| 2,159,356 A * | 5/1939 | Lambert | 221/236 |
| 3,189,222 A * | 6/1965 | Smalley | 221/220 |
| 3,622,041 A | 11/1971 | Borsum et al. | |
| 4,966,305 A | 10/1990 | Hinterreiter | |
| 5,071,033 A * | 12/1991 | Siwek | 221/229 |
| 6,425,495 B1 * | 7/2002 | Senda et al. | 221/24 |
| 6,543,639 B1 * | 4/2003 | Kovens | 221/24 |

FOREIGN PATENT DOCUMENTS

| | | |
|---|---|---|
| EP | 0 629 562 A1 | 12/1994 |
| JP | 1967-18445 | 10/1967 |
| JP | 1977-165852 | 12/1977 |
| JP | 1985-101468 | 7/1985 |
| JP | 1988-63463 | 3/1988 |
| JP | 1991-75107 | 7/1991 |
| JP | 1992-189784 | 7/1992 |
| JP | 11079262 | 3/1999 |
| JP | 1999-255210 | 9/1999 |
| JP | 2000-025845 | 1/2000 |
| JP | 2000-159279 | 6/2000 |
| JP | 2001-019064 | 1/2001 |

* cited by examiner

*Primary Examiner*—Gene O. Crawford
*Assistant Examiner*—Timothy Waggoner
(74) *Attorney, Agent, or Firm*—Mitchell P. Brook; Luce, Forward, Hamilton & Scripps LLP

(57) ABSTRACT

An item taking-out container making it possible to take out small items, such as candies or chocolates, one by one is composed of a container main body equipped with an accommodating portion capable of accommodating a plurality of items of a predetermined configuration and a cover member, an opening communicating with the accommodating portion being formed at a predetermined position on the surface of the container main body, the cover member being rotatably supported with respect to the container main body in order to close the opening so as to allow opening/closing, there being provided on the back side of the cover member an item taking-out means for holding the items accommodated in the accommodating portion and taking the items out of the container main body as the cover member is opened.

2 Claims, 4 Drawing Sheets

ITEM TAKING-OUT CONTAINER

TECHNICAL FIELD

The present invention relates to an item taking-out container, which allows sweets such as candies or chocolates, accommodated in a case main body, to be taken out.

BACKGROUND ART

JP 2000-159279 A discloses an example of a known conventional item taking-out container, which contains items like sweets and allows them to be taken out one by one. This conventional item taking-out container is designed such that sweets are stacked together in a case main body, and a doll serving as an ornament takes out the sweets one by one starting with the uppermost one.

Similar examples of an item taking-out container which allows accommodated items to be taken out one by one are disclosed in Japanese Utility Model Publication No. 42-18445, JP 7-114793 B, JP 2000-25854 A, U.S. Pat. No. 4,966,305 B, etc.

However, the above-mentioned conventional item taking-out containers are intended for taking out items stacked together in a predetermined order, and do not allow items accommodated in an irregular fashion to be taken out one by one.

Further, when accommodating items in the container, it is necessary to stack them together regularly in a predetermined order. Thus, for example, there is a case where an infant finds it difficult to perform the operation of accommodating items in the container.

Further, in the conventional item taking-out containers, the holding members for holding the items are normally exposed, so that they are subjected to adhesion of dust.

SUMMARY OF THE INVENTION

The present invention has been made in view of the above problems in the prior art. It is an object of the present invention to provide an item taking-out container structure, which allows small items, such as candies or chocolates, accommodated in an irregular fashion to be taken out one by one.

An item taking-out device as claimed in Claim 1 of the present invention has the following features:

(A) It is composed of a container main body equipped with an accommodating portion capable of accommodating a plurality of items of a predetermined configuration and a cover member.

(B) The container main body has at a predetermined position on its surface an opening communicating with the interior of the container main body, and the cover member is provided on the container main body in order to close the opening such that it can be opened and closed.

(C) On the back surface of the cover member or in the vicinity thereof, there is provided an item taking-out means for holding an item accommodated in the container main body and taking it out of the container main body as the cover member is opened.

Further, according to Claim 2, there is provided an item taking-out container as claimed in Claim 1 having the following features:

(A) The container main body is provided with an attitude regulating means for regulating items accommodated in an irregular attitude into an attitude, which allows them to be held by the item taking-out means.

(B) At a predetermined position in the container main body opposed to the item taking-out means, there is provided an item retaining means for retaining the items in a state in which they have been regulated into the attitude.

Further, according to Claim 3, there is provided an item taking-out container as claimed in Claim 2, in which there is formed in all or a part of the bottom portion of the accommodating portion a slope descending toward the attitude regulating means and/or the item retaining means.

The item taking-out device of the present invention, constructed as described above, provides the following effects:

According to the invention of Claim 1, it has an effect that it is possible to provide a novel item taking-out container having, due to the item taking-out means provided on the back surface of the cover member or operationally connected thereto, an effect to be able to take out items one by one solely by opening and closing the cover member.

Further, there is no need to put items in the accommodating portion in a regular fashion as in the case of conventional item taking-out devices. Thus, there is an effect, which cannot be seen in the conventional ones, that even an infant, for example, can easily put items in the container main body.

Further, when a toy animal, a character figure or the like is used in the item taking-out means, and its portions corresponding to arms are utilized as the holding members, there is an effect that it is fun to look at such a character figure performing the operation of taking out items.

Further, since the item taking-out means is provided on the back surface of the cover member so that it may hold an item when the cover is closed, an item can be taken out simultaneously with the opening of the cover, thus there is an effect that it can realize an operation which is fun to look at.

Further, when no item is to be taken out (that is, when the container is not used), the cover member can be kept closed, so that the holding members for holding items are relatively free from adhesion of dust, thus there is an effect that the interior of the item accommodating portion is protected against intrusion of dust.

In addition to the above, the invention as claimed in Claim 2 provides the following effect that it is possible to supply items in a regulated attitude efficiently to the item retaining portion, since there is provided a means for regulating items, such as candies or chocolates, accommodated in the container in an irregular fashion into a predetermined attitude. Due to this arrangement, there is an effect that it is possible to efficiently take out items as the cover is opened and closed.

Further, according the invention of Claim 3, the bottom surface of the accommodating portion accommodating items is formed as a slope descending toward the item retaining portion, thus there is an effect that it is possible to efficiently supply the items to the item retaining portion.

DESCRIPTION OF PREFERRED EMBODIMENTS OF THE INVENTION

An embodiment of the present invention will be described with reference to FIGS. 1 through 4.

Figure 1:
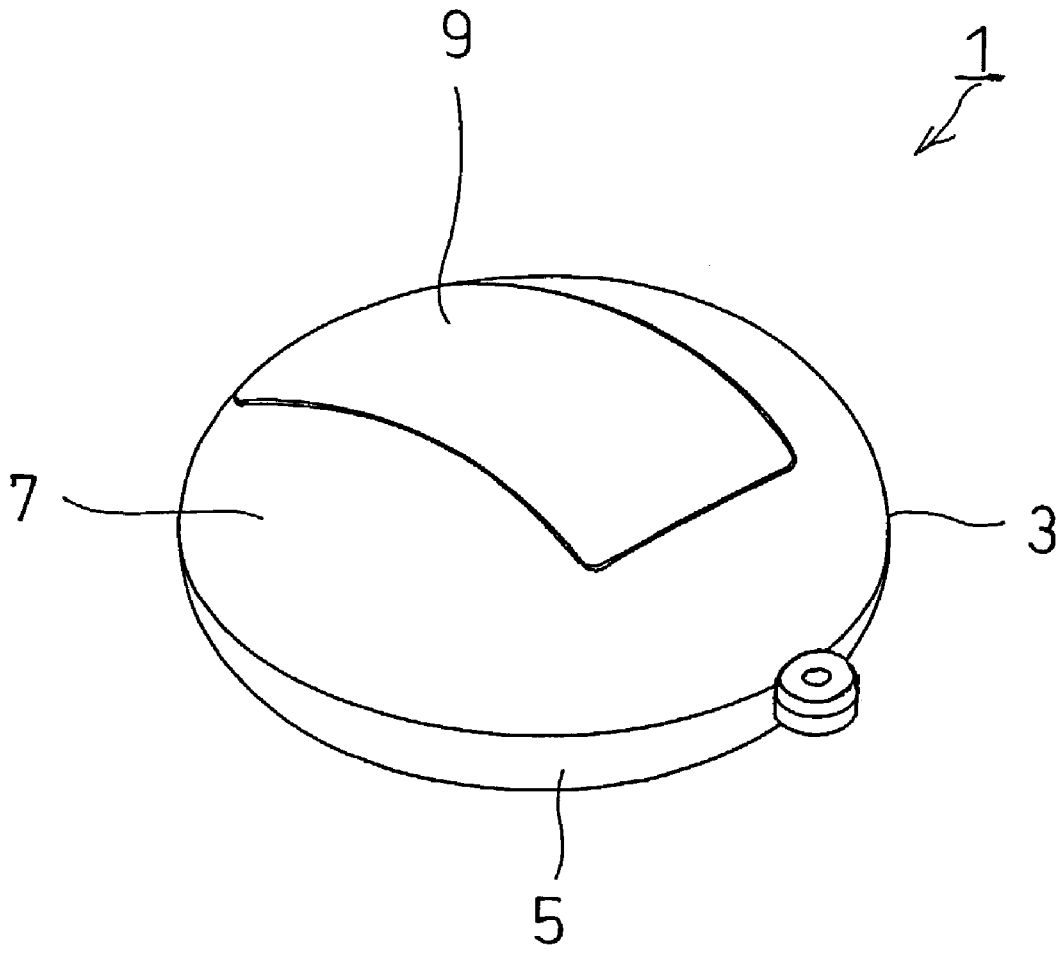
FIG. 1 is a diagram showing the outward appearance of an item taking-out container according to an embodiment of the present invention.
Figure 2:
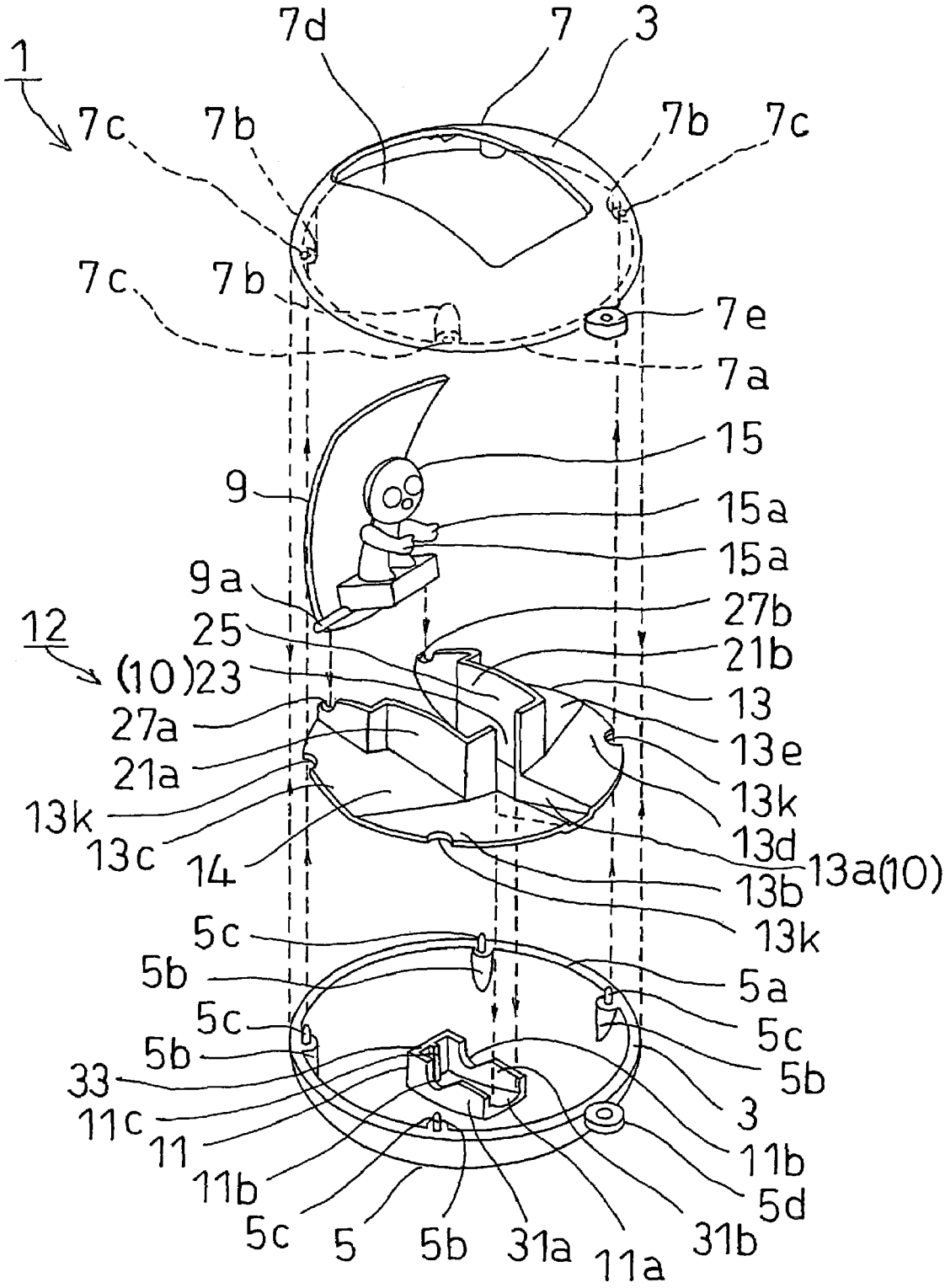
FIG. 2 is an exploded perspective view of an item taking-out container according to an embodiment of the present invention.
Figure 3:
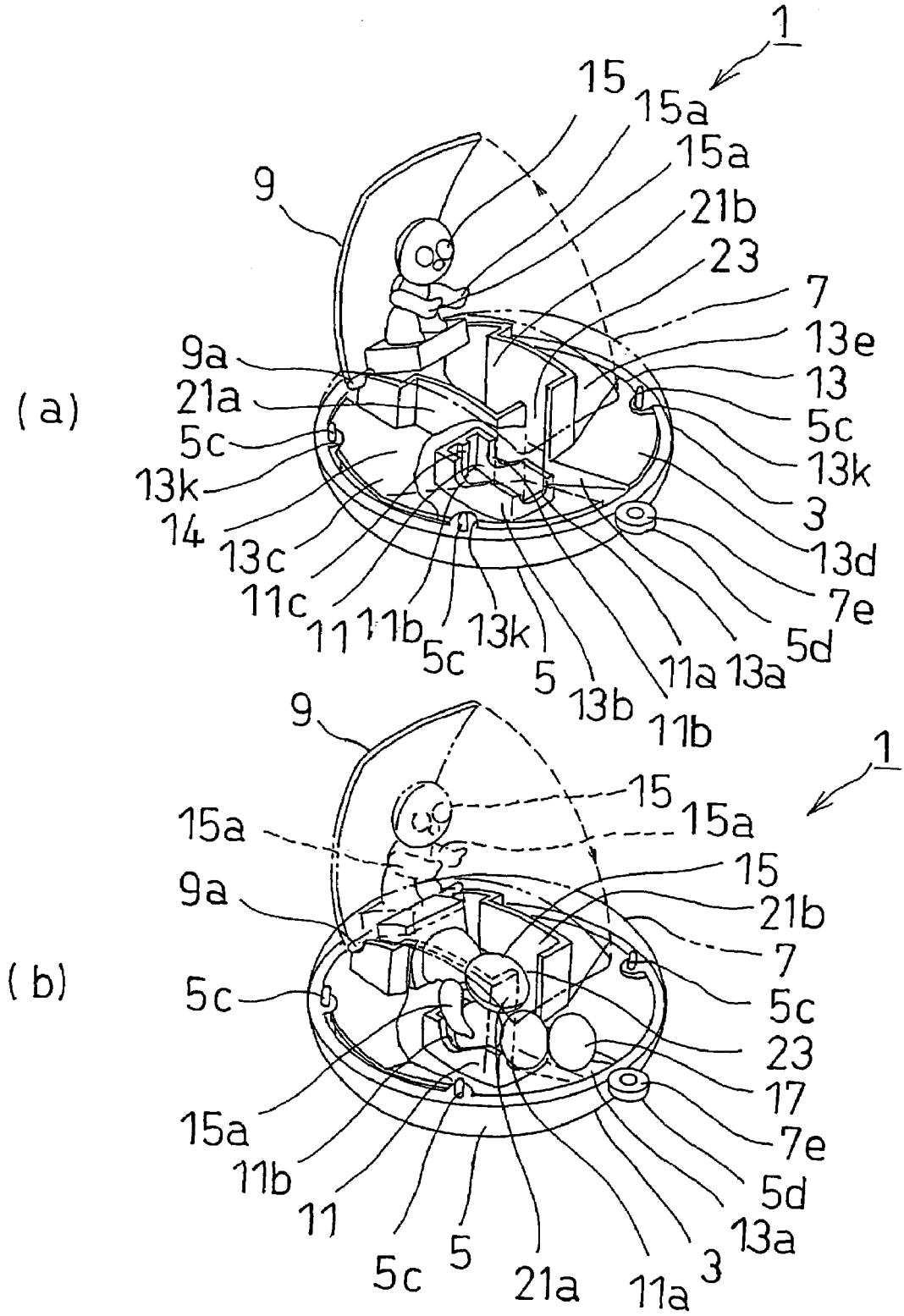
FIG. 3 is a perspective view illustrating the operation of an item taking-out container according to an embodiment of the present invention.
Figure 4:
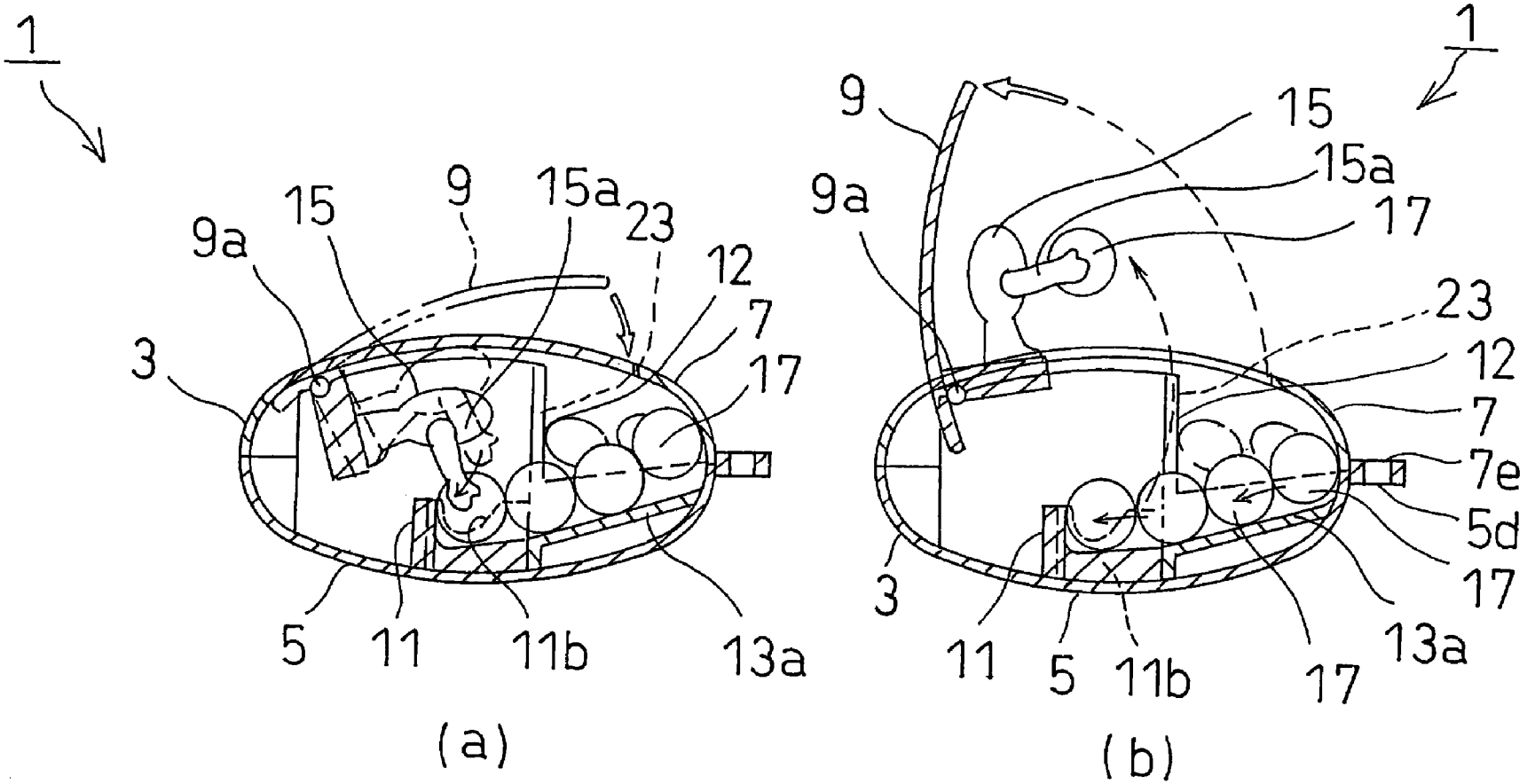
FIG. 4 is a sectional view of an item taking-out container according to an embodiment of the present invention.

FIG. 1 is a perspective view of the outward appearance of an item taking-out container 1 according to the present invention. FIG. 2 is an exploded perspective view of the item taking-out container 1. FIG. 3 is a see-through perspective view of the item taking-out container 1. FIG. 4 is a longitudinal sectional view of the item taking-out container.

In FIGS. 1 and 2, reference numeral 3 indicates a container main body for accommodating items like sweets described below. The shell of the container main body 3 is composed of a lower container body 5 and an upper container body 7 joined thereto from above to form a hollow member having a space inside when the bodies 5 and 7 are joined together.

When the lower container body 5 and the upper container body 7 have been joined together, the container main body 3 exhibits a flat configuration as obtained by flattening a sphere from above and below. That is, as shown in the sectional view of FIG. 4 referred to below, the container main body 3 has an elliptical sectional configuration with a vertical minor axis and a horizontal major axis.

As stated above, the container main body 3 includes a space, in which items 17 consisting, for example, of solid sweets, such as candies or chocolates are accommodated.

Further, as stated above, the container main body 3 is mainly composed of the lower container body 5, the upper container body 7, and a cover member 9. Next, the lower container body 5 and the upper container body 7 will be described in detail.

In this embodiment, the items 17 have a tablet-like configuration as obtained by flattening a sphere, and each member of the container main body 3 is shaped in conformity with the configuration of the items 17. The configuration of the items is not restricted to the above-described one; it may also be a more sphere-like configuration, in which case each member is formed accordingly.

The lower container body 5 is a shell member constituting the lower half of the container main body 3, and it is a bowl-like member with an upwardly opened round opening. On the inner side of an upper edge 5*a* forming the opening, there are provided, at equal intervals, four inwardly directed locking protrusions 5*b* for locking an intermediate member 12 described below. Further, on top of the locking protrusions 5*b*, there are provided upwardly directed engagement protrusions 5*c* respectively, which protrude upwardly beyond the upper edge 5*a* for fitting engagement with the upper container body 7.

At one side of the upper edge 5*a*, there is provided an outwardly directed string-hole portion 5*d*, which allows the item taking-out container 1 to be suspended. When a predetermined string is passed through the string-hole portion 5*d* and looped, it is possible for the container 1 to be suspended from a person's neck or wrist or a hook on a wall or the like.

In the following description of this embodiment, the side where the string-hole portion 5*d* is provided will be referred to as the front side of the container main body 3, and the side where no string-hole portion 5*d* is provided will be referred to as the rear side thereof.

The upper container body 7 is a shell member constituting the upper half of the container main body 3, and it is a bowl-like member with a downwardly opened round opening. A lower edge 7*a* forming the opening is a portion opposed to the upper edge 5*a* of the lower container body 5 for joining together, and has substantially the same size as the upper edge 5*a*.

On the inner side of the lower edge 7*a*, there are provided inwardly directed predetermined protrusions 7*b*. The protrusions 7*b* are provided with engagement holes 7*b* opposed to engagement protrusions 5*c* of the lower container body 5 and adapted to be engaged therewith. Further, on the outer side of the front portion of the lower edge 7*a*, there is provided a string-hole portion 7*e* to be matched with the string-hole portion 5*d* of the lower container body 5.

Further, in the upper-side surface of the upper container body 7, there is formed a substantially rectangular opening 7*d* of a predetermined size extending a long a line connecting the front and rear sides of the container main body 3.

In the opening 7*d*, there is provided a cover member 9 having an external configuration substantially in conformity with the opening 7*d* and adapted to close the opening 7*d*, the cover member being capable of being opened and closed.

As stated above, the cover member 9 is intended to close the opening 7*d* of the upper container body 7 and is capable of being opened and closed. In this embodiment, the cover member 9 has a curved surface configuration such that, in the closed state, it is flush with the surface of the upper container body 7.

Further, at one end portion of the cover member 9, there is provided a rotation shaft 9*a* somewhat protruding on either side. As will be described in detail below, this rotation shaft 9*a* is rotatably supported by the intermediate member 12 and serves as a rotation fulcrum for the cover member 9.

Further, on the back surface of the cover member 9, there is provided an item taking-out means 15, which will be described below.

Inside the container main body 3, there are further provided an item retaining portion 11, the intermediate member 12, and an accommodating portion 14, which will be described below.

As described below, the item retaining portion 11 serves to retain one item 17 to be taken out while allowing the item to maintain a predetermined attitude, and is provided substantially at the center of the bottom of the interior of the lower container body 5.

The item retaining portion 11 is composed of a pair of right and left side walls 31 (31*a* and 31*b*) extending in the longitudinal direction, which corresponds to the front-to-rear direction of the container main body 3, and a rear wall 33 provided so as to close the rear side of the side walls, and it is formed so as to be open on the upper and front sides. As stated above, the item retaining portion 11 has on its front side an opening 11*a*, which serves as an inlet for the items 17. Further, the right and left side walls 31*a* and 31*b* have substantially semi-circular cutouts 11*b* so as to allow movement of the item taking-out means 15 (described in detail below) and undisturbed holding of an item supplied into the item holding portion 11.

The right and left side walls 31*a* and 31*b* stand upright with a distance therebetween allowing movement of the item 17 and retainment thereof in an erect attitude, that is, with a distance somewhat larger than the thickness of the item 17. Further, inside the item retaining portion 11 and substantially at the center of the inner side of the rear wall 33, there is provided an item holder 11*c* having a predetermined width and protruding forwards, and it serves to hold one item 17 put in the item retaining portion 11 at a predetermined position.

Further, as long as the item retaining portion 11 is able to keep the attitude of the item 17 so as to allow the item to be taken out by the item taking-out means 15, it is not always necessary for the item retaining portion 11 to be capable of securing the item 17 in position so as to prevent it from moving. It is only necessary for the item retaining portion (11) to be able to keep the item in a fixed attitude.

Next, an attitude regulating means 10 provided in the container main body 3 will be described. The attitude regulating means 10 serves to bring the item 17 accommodated in an irregular fashion into a fixed attitude, allowing the item 17 to be accommodated in the item retaining portion 11. In this embodiment, the attitude regulating means 10 is provided integrally with a member forming a bottom plate 13 of an accommodating portion 14 accommodating the item and with a partition wall 21 standing upright so as to surround the item retaining portion. In a part of the partition wall 21, there is provided a narrow opening 23 opposed to the opening 11*a* of the item retaining portion.

The bottom plate 13, which is formed integrally with the attitude regulating means 10, is provided with a slope or the like for causing the item 17 to slide or roll toward the item retaining portion 11. In this embodiment, the bottom plate 13 has a symmetrical configuration and is equipped with a groove 13*a* having a bottom surface inclined from the center of the front side toward the rear side. The groove 13*a* has substantially the same width as the opening 23, and the downwardly inclined bottom surface is connected to the bottom surface of the item retaining portion 11 so as not to involve any difference in level therebetween. That is, as described below, the item 17 having entered the groove 13*a* rolls inside the groove 13*a* to enter the item retaining portion 11 through the opening 23.

Further, in the front portion of the bottom plate 13 and on the left side of the groove 13*a*, there is provided a gentle slope 13*b*, which is gently inclined from the left-hand side toward the center so as to gather the items 17 in the groove 13*a*. Further, in the rear portion of the bottom plate 13 connected to the gentle slope 13*b*, there is provided a rear inclined surface 13*c* inclined somewhat steeply from the rear side toward the front side.

Similarly, on the right-hand side of the groove 13*a*, there is provided a gentle slope 13*d* gently inclined from the right-hand side toward the center, and, in the rear portion of the bottom plate 13 connected to the gentle slope 13*d*, there is provided a slope 13*e* inclined somewhat steeply from the rear side toward the front side.

Further, substantially at the center of the bottom plate 13, partition walls 21 (21*a* and 21*b*) stand symmetrically so as to surround the item retaining portion 11 with a predetermined gap therebetween. Due to this construction, the portion surrounded by the outer sides of the partition walls 21, the upper portion of the bottom plate 13, and the inner side of the upper container body 7 forms an accommodating portion 14 accommodating a plurality of items 17. And, the items 17 accommodated in the accommodating portion 14 move on the gentle slopes 13*b* and 13*d* and the rear slopes 13*c* and 13*e* to be gathered in the groove 13*a*.

As described above, the exterior of the partition walls 21 constitutes the accommodating portion 14 for the items 17, whereas the interior of the partition walls 21 constitutes an accommodating space 25 large enough to allow emerging and submerging of the item taking-out means 15 adapted to move with the opening and closing of the cover 9. In this embodiment, the space 25 is formed such that its width decreases stepwise as it extends from the rear side to the front side in conformity with the configuration of the item taking-out means 15; the above-mentioned opening 23 is formed on the front side of the space.

Further, the height of the partition walls 21 is determined such that when the cover member 9 is closed, their upper edges abut the back surface thereof, with the cover member 9 being kept in a position where it is flush with the surface of the upper container body 7. Further, in the rear portions of the upper edges of the partition walls 21, there are provided cutouts 27 (27*a* and 27*b*) serving as bearing portions for rotatably supporting the rotation shaft 9*a* of the cover member 9. By attaching the upper container body 7, the upper sides of the cutouts 27 are closed so that the rotation shaft 9*a* supported may be held so as not to come off.

The contour of the bottom plate 13 is substantially circular in conformity with the configuration of the inner-side portion of the lower container body 5 near the opening. The bottom plate 13 is attached to the inner side surface of the lower container body 5. At predetermined positions of the outer edge of the bottom plate 13, there are provided locking cutouts 13*k* corresponding to the locking protrusions 5*b* provided on the lower container body 5. The locking cutouts 13*k* are engaged with the locking protrusions 5*b* for locking, whereby the bottom plate 13 is attached to the inner surface of the lower container body 5. As stated above, in this condition, the opening 11*a* of the item retaining portion 11, the groove 13*a* of the bottom plate 13, and the opening 23 are matched with each other in position.

Next, the item taking-out means 15 will be described.

The item taking-out means 15 is provided at a predetermined position on the back surface of the cover member 9, and has a pair of arm-like holding members 15*a*. In this embodiment, the item taking-out means 15 consists of an ornament in the form of a toy animal or an animated-film character or the like, the portions corresponding to the arms of the character constituting the pair of holding members 15*a*.

The holding members 15*a* consist of flexible members adapted to hold therebetween the item 17 arranged in the item retaining portion 11. In this embodiment, the distance between the holding members 15*a* is, for example, approximately 5 mm, which corresponds to the thickness of the item 17.

That is, when the cover member 9 provided with the item taking-out means 15 is closed, the item taking-out means 15 holds one item 17 placed at a predetermined position of the item retaining portion 11, and as the cover member 9 is opened, the item 17 held can be taken out of the item taking-out means 15.

Next, the way a plurality of items 17 accommodated in the item taking-out container 1 constructed as described above are taken out one by one will be described.

By depressing the rear portion of the cover member 9 of the item taking-out container 1, the front portion of the cover member 9 is raised, and the cover member 9 is opened. When the cover member 9 has been opened, the items 17 to be taken out one by one later on are put in the exterior of the partition walls 21*a* and 21*b* (the accommodating portion 14) through the opening 7*d* of the cover member 9.

By lightly shaking or swaying the container main body 3, the first one of the items 17 accommodated in the accommodating portion 14 is caused to slide into the groove 13*a* from the rear slope 13*c*, 13*e* and the gentle slope 13*b*, 13*d*. At this time, the first item 17 is guided by the groove 13*a* and rolls on the inclined bottom surface thereof to be supplied to the item retaining portion 11 through the opening 23. In this way, the groove 13*a* and the opening 23 serve as the attitude regulating means for regulating the item 17 into a position allowing it to be held by the holding members 15*a* and supplying it to the item retaining portion 11.

Subsequently, two or three items 17 successively slide down into the groove 13*a* from the rear slopes 13*c* and 13*e* and the gentle slopes 13*b*, 13*d*, and a state is attained in which the items are aligned in the groove 13*a* to be supplied to the item retaining portion 11.

When, in the state in which the item 17 has been supplied to the item retaining portion 11, the cover member 9 is closed on the container main body 3, the holding members 15*a* of the item taking-out means 15 provided on the back side of the cover member 9 are rotated downwardly to draw an arc to hold the first item 17, as shown in FIGS. 3(*a*) and 4(*a*). As described above, the cutouts 11*b* are provided in the side walls 31*a* and 31*b* of the item retaining portion 11, and gaps are provided between the item retaining portion 11 and the partition walls 21*a* and 21*b*, whereby the holding portions 15*a* of the item taking-out means 15 holds the portion of the item 17 where its width is substantially maximum without coming into contact with the item retaining portion 11 and the partition walls 21*a* and 21*b*.

Further, since no unnecessary item 17 is allowed to enter the space surrounded by the partition walls 21*a* and 21*b*, there is no danger of the unnecessary item 17 hindering the rotation of the item taking-out means 15.

Next, when the cover member 9 is opened again, the pair of holding portions 15*a* of the item taking-out means 15 moves upwardly from below to draw an arc while holding the first item 17, and takes the item 17 out of the container main body 3 (See FIGS. 3(*b*) and 4(*b*)).

On the other hand, as soon as the first item 17 accommodated in the container main body 3 is taken out, the item retaining portion 11 becomes empty, so that the next item 17 in the groove 13*a* is supplied to the item retaining portion 11. Since two or three items 17 stand in a row in the groove 13*a*, each time an item 17 is taken out, another item 17 slides down into the groove 13*a* from the rear slope 13*c*, 13*e* and the gentle slope 13*b*, 13*d*, and an item 17 is supplied to the item retaining portion 11.

In this way, the items 17, which are in irregular attitudes in the accommodating portion 14 of the container main body 3, are regulated into a fixed attitude as they pass through the opening 23 after entering the groove 13*a* from the rear slopes 13*c* and 13*e* and the gentle slopes 13*b* and 13*d* before being supplied to the item retaining portion 11. When, in this condition, the cover member 9 is closed and opened, it is possible to take out one by one the items 17 accommodated in the accommodating portion 14 in an irregular fashion.

While in the above-described embodiment the cover member 9 has a rectangular configuration, this should not be construed restrictively.

Further, while in the above embodiment the item taking-out means is fixed to the back surface of the cover, it is also possible to adopt some other construction as long as it consists of a mechanism in which the opening/closing of the cover is operationally connected with the item taking-out means.

Further, while in the above embodiment the items to be taken out by the item taking-out means have a tablet-like configuration as obtained by flattening a sphere, they may also be of a spherical or an annular configuration; there is no particular restriction regarding the item configuration as long as it allows regulation into a predetermined attitude.

The present invention provides a technique applicable to an item taking-out container, which allows sweets, such as candies or chocolates, accommodated in a case main body, to be taken out.

What is claimed is:

1. An item taking-out device comprising:

(A) a container main body equipped with an accommodating portion capable of accommodating a plurality of items having a tablet-like configuration as obtained by flattening a sphere, and a cover member;

(B) an opening communicating with the interior of said container main body formed at a predetermined position on the surface of the container main body, wherein said cover member is provided on said container main body in order to close the opening such that it can be opened and closed;

(C) an item taking-out means provided on the back surface of said cover member or in the vicinity thereof for holding an item accommodated in said container main body and taking it out of the container main body as said cover member is opened;

(D) an attitude regulating means, provided on said container main body, for regulating items accommodated in an irregular attitude into an erect attitude that allows the items to be held by said item taking-out means;

(E) an item retaining means, provided at a predetermined position in the container main body facing said item taking-out means, for retaining the items in a state in which they are regulated into said attitude;

(F) a slope descending toward said attitude regulating means and/or the item retaining means formed on all or a part of the bottom portion of said accommodating portion;

(G) wherein the item retaining means includes a pair of right and left side walls facing each other, and an opening serving as an inlet for allowing the item to enter into the item retaining means;

(H) wherein the attitude regulating means provided on said container main body includes partition walls symmetrically standing upright so as to surround the item retaining means at a predetermined distance, and a narrow opening is provided in a part of the partition wall at the position facing the opening of the item retaining portion; and (I) wherein the partition walls constitute an accommodating space large enough to allow emerging and submerging of the item taking-out means moving along with the opening and closing movement of the cover member.

2. The item taking-out device as provided in claim 1 wherein the plurality of items comprise candy.

* * * * *